US005225610A

United States Patent [19]

Uria

[11] Patent Number: 5,225,610

[45] Date of Patent: Jul. 6, 1993

[54] ONE-SHOT WEAPONS

[76] Inventor: José F. Uria, Residence Ondarraitz II, 52 bd de la Baie de Chingoudy, France

[21] Appl. No.: 734,536

[22] Filed: Jul. 23, 1991

[30] Foreign Application Priority Data

Jul. 23, 1990 [FR] France ..... 90 09716

[51] Int. Cl.[5] ..... F41A 3/58

[52] U.S. Cl. ..... 42/40; 42/44; 42/75.04

[58] Field of Search ..... 42/40, 41, 42.01, 42.03, 42/44, 75.02, 75.04

[56] References Cited

U.S. PATENT DOCUMENTS

| | | | |
|---|---|---|---|
| 1,507,411 | 9/1924 | Zugaja | 42/44 |
| 3,561,149 | 2/1971 | Center | 42/44 |
| 4,156,980 | 6/1979 | Aspenwall | 42/44 |
| 4,276,708 | 7/1981 | Chase | 42/44 |
| 4,602,450 | 7/1986 | Hoenig | 42/75.02 |
| 4,774,929 | 10/1988 | Milliman | 42/75.04 |
| 4,891,898 | 1/1990 | Houseman | 42/75.04 |
| 4,914,845 | 4/1990 | Reese et al. | 42/40 |

*Primary Examiner*—Charles T. Jordan

*Attorney, Agent, or Firm*—Eckert Seamans Cherin & Mellott

[57] ABSTRACT

A one-shot weapon includes an external grip, a profiled receiver attached to the grip, and a supporting base hingedly attached to the receiver. A sleeve is connected to the supporting base, and a barrel is disposed in the sleeve. A firing block has a cube-shaped head mounted on a top part of the receiver and abutting against a vertical wall of the receiver. The firing block is interchangeable on the receiver and allows for annular or central firing. A trigger connected to the receiver is operable by a trigger tang. A barrel release connected to the receiver defines a trigger guard for protecting the trigger tang. The receiver has an adjusting mechanism for enabling adjustment of a trigger stroke. A safety mechanism is pivotably attached to the receiver.

13 Claims, 6 Drawing Sheets

ONE-SHOT WEAPONS

The invention relates to the technical sector of weapons, particularly precision shooting pistols, rifles and hunting guns.

With regards to the prior art, the first object of the invention relates to the capacity of transforming a weapon as a function of the requirements and uses, i.e. into a rifle, from interchangeable modular components.

Another aim sought after according to the invention was to offer different position adjustments of certain component parts of the weapon enabling it to be suitably adapted to the conditions of use.

Another aim sought after according to the invention was to produce a weapon with an additional safety device.

Another aim sought after according to the invention was to design a weapon with a specific locking mechanism.

Another aim sought after according to the invention was to separate the position of the barrel with respect to the receiver of the weapon.

These aims and other will be made well apparent from the following description.

According to a first characteristic of the invention, the weapon is remarkable in that its receiver is equipped to take a supporting base of a sleeve-barrel assembly, capable of being hinged and guided, the said sleeve being associated to the receiver thereby freeing the barrel from any stresses, the said receiver taking a locking mechanism associated to the barrel release forming a trigger guard protecting the trigger tang, the said receiver enabling the positioning of a modulable firing block, the said receiver being designed to take a mechanism enabling adjustments to be defined before the shot is released or afterwards, the said receiver taking an additional safety mechanism.

These characteristics and others will be made well apparent from the following description.

In order to clarify the object of the invention, it is illustrated in a non-limitative manner in the figures of the drawings where:

FIG. 1 is a side view showing the weapon.

FIG. 2 a perspective, blown-up view before assembly, illustrating the different component means of the weapon.

Figure 1:
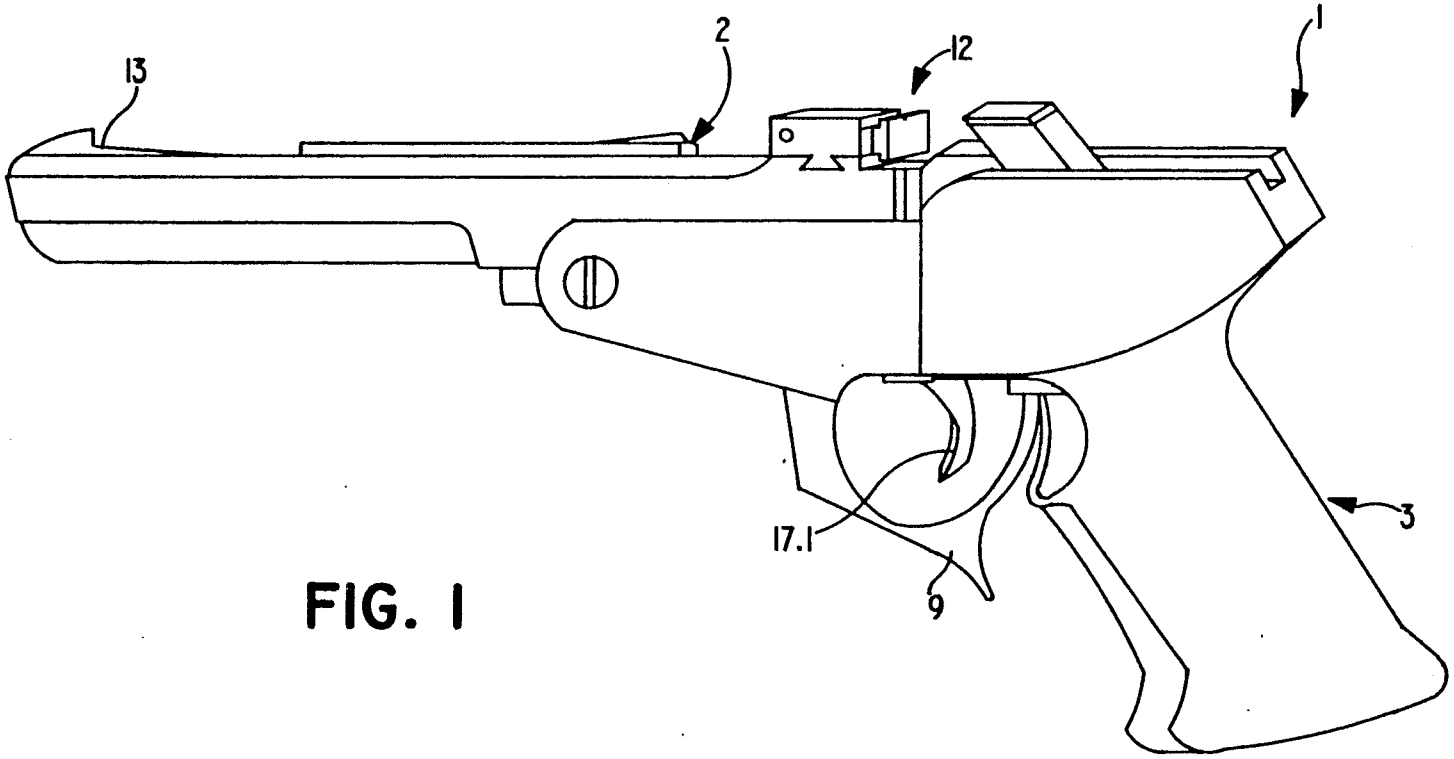
Figure 2:
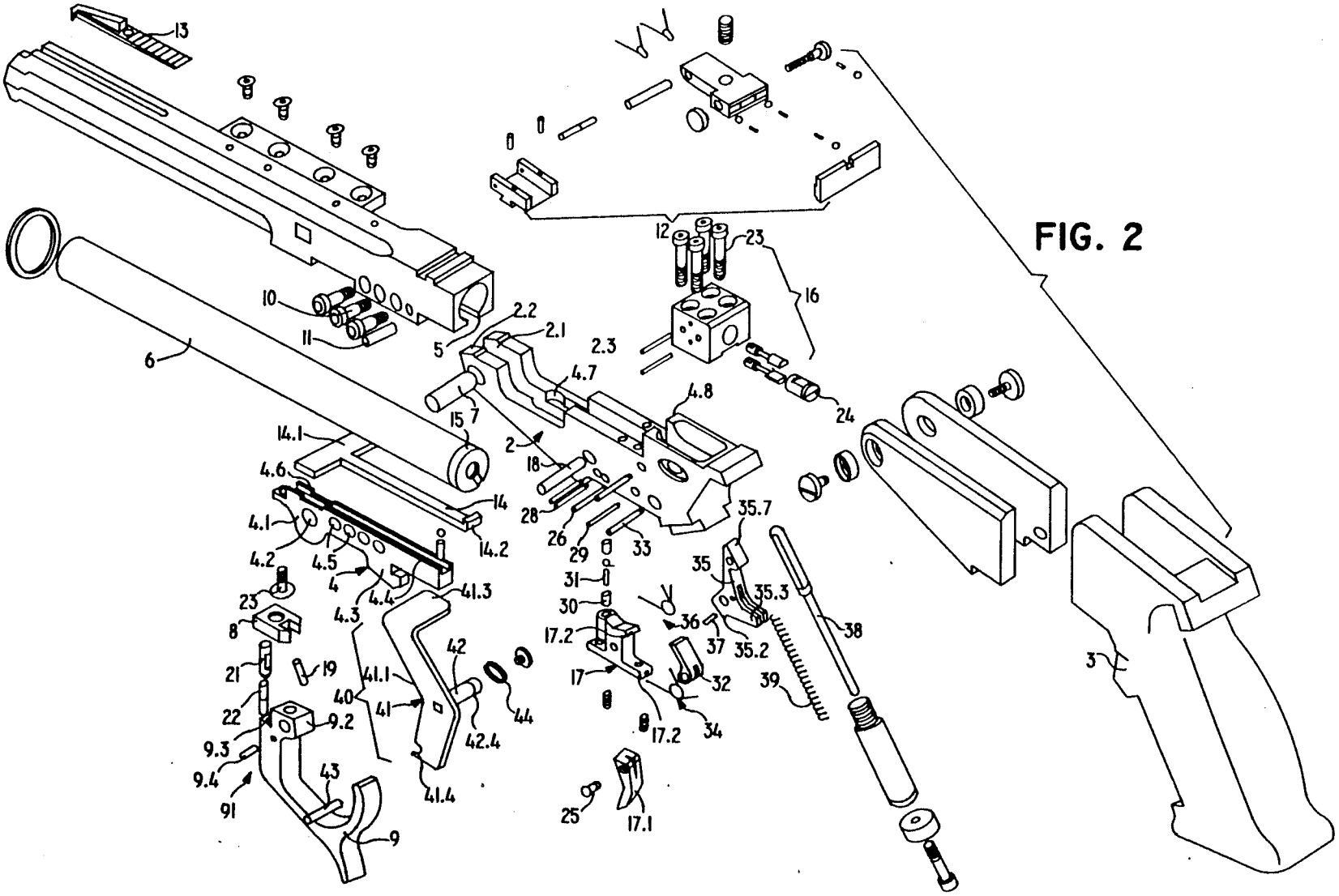
Figure 3:
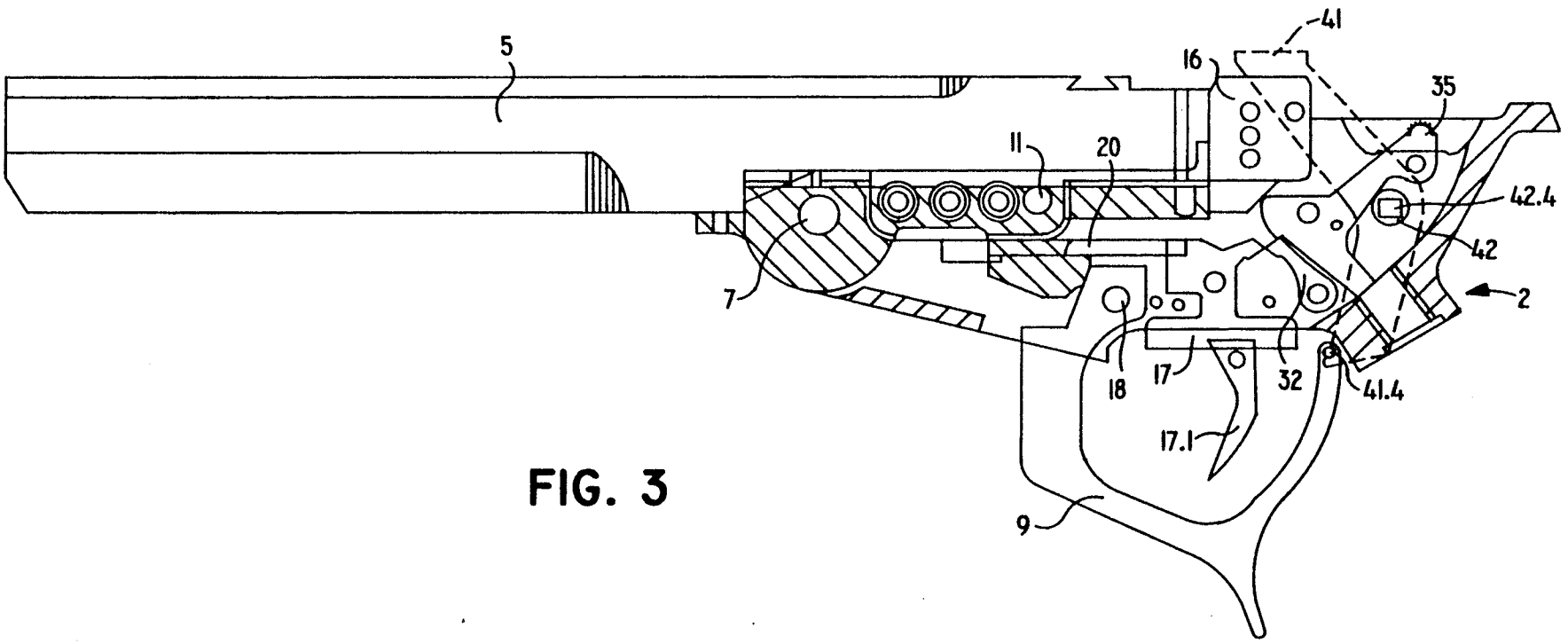
FIG. 3 is a schematic view illustrating the main components of the weapon according to the invention in the shooting position, ready to be fired.
Figure 4:
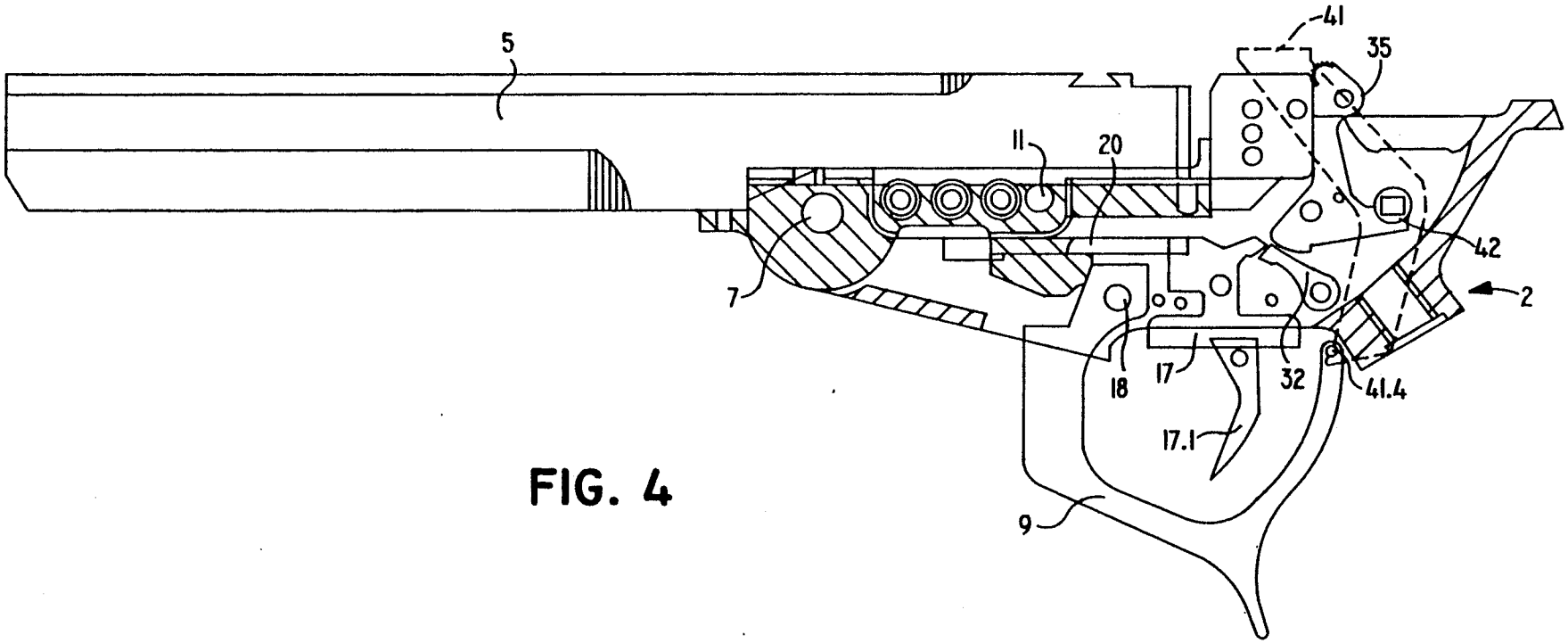
FIG. 4 is a view similar to FIG. 3, with the shot fired.
Figure 5:
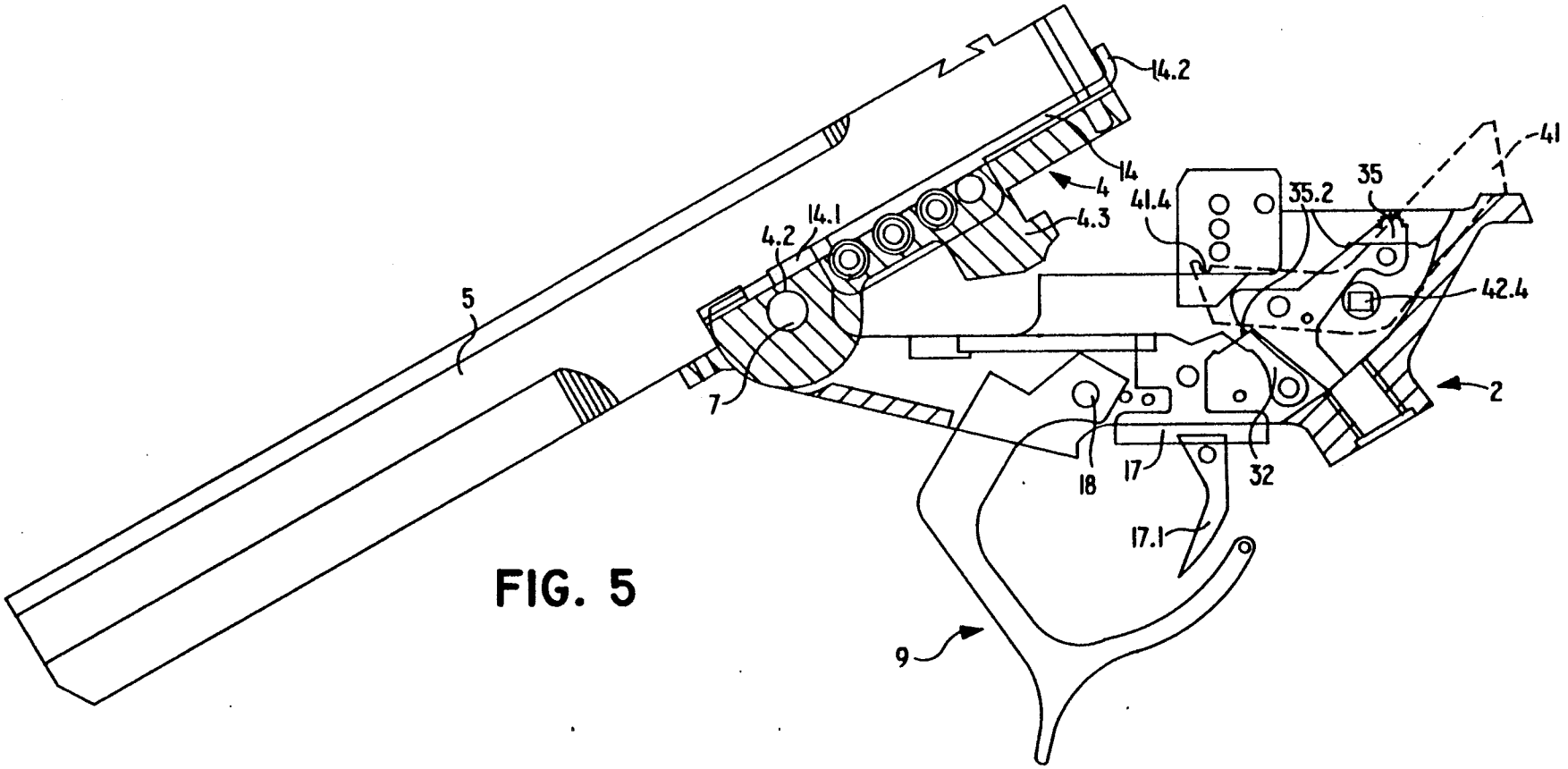
FIG. 5 is a view of the weapon in the open position and the barrel broken down.
Figure 6:
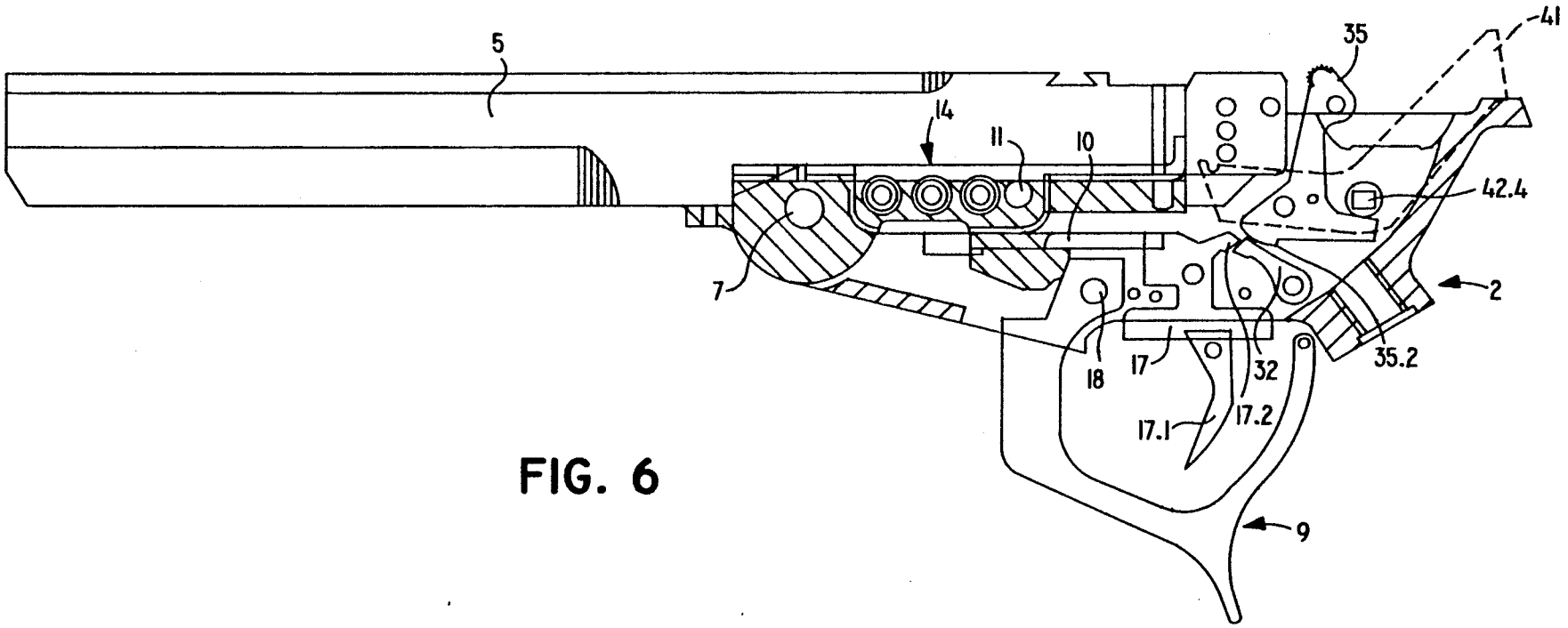
FIG. 6 is a view of the weapon in the closed position for loading a shell before cocking the hammer.

In order to clarify the object of the invention, it is now described in a non-limitative manner, illustrated in the drawings.

It is firstly specified that the weapon according to the invention, generally referred to as (1) can be a one-shot pistol namely meant for training in precision shooting with the arm straight (25 or 50 meters with the lightweight receiver model (aluminium alloy) and also firing at a metal target with the small caliber production category. As an alternative model, the receiver can be made of steel and the weapon is meant to shoot against a metal target with the small or large caliber production category.

The different characteristics of the invention will now be referred to.

The weapon comprises a profiled receiver (2), equipped to take the grip (3) externally and the different mechanisms for its operation, internally.

The said receiver (2) had two spaced and parallel side plates or jaws (2.1 - 2.2), internally limiting the space required for the passage and positioning of the different mechanisms of the weapon. The front part of the receiver forms a yoke (2.3) to allow for a supporting base (4) of the sleeve (5), barrel (6) assembly, to pass and be hinged. Therefore, the front part (4.1) of this supporting base is round, equipped with a transversal opening (4.2) for the hinge pin (7) to pass. The rear part of the supporting base is shaped like a hook (4.3) cooperating with a sliding means (8) associated to the barrel release (9), as specified in the following description. Furthermore, the top part of the supporting base is designed with a longitudinal recess (4.4) for the extractor to pass and be guided. The middle part of the supporting base has openings (4.5) for the introduction of pins (10) providing the connection and fixing of the sleeve (5). Three connecting screws are provided to fix the sleeve with respect to the supporting base and one pin (11) rotating the base with respect to the sleeve to facilitate its assembly. There may be adjustment of the position of the sleeve according to the requirements. The sleeve is equipped with an internal recess to take and guide the barrel. Sighting means (12 - 13) of the known type are built up and positioned on the top face of the sleeve, at the front and rear of it.

In FIG. 1, the sighting means (12 - 13) have been illustrated by separate components but are within the usual technique and are not described in detail.

As illustrated in the drawings, the extractor (14) is profiled and T-shaped (14.1) at one end, likely to enable controlled and limited sliding with respect to the supporting base. For this purpose, it has notches (4.6) providing limited clearance. The front part of the extractor forms a hook (14.2) to come in register with the outlet of the barrel and play its part for this purpose.

Furthermore, rim recess adjusting washers (15) are arranged between the barrel and the hooked part of the extractor. This kind of assembly of the barrel, with respect to the sleeve, offers many advantages. Firstly, it is easier to assemble the barrel or replace it along with the corresponding extractors according to the calibers used. Furthermore, the sleeve has the advantage of supporting the sighting components and being used to form a link with the receiver, which eliminates any stress on the barrel. Furthermore, another advantage is represented in the fact that the barrel is independent to the locking system which will be described in the following description, thereby enabling the rim recess (space between the barrel and firing block) to be adjusted, by fitting interchangeable washers (15) of different thicknesses.

Furthermore, this kind of assembly has another essential advantage of acting as a heat sink when the barrel heats up too much due to the shot or a prolonged exposure to the sun, by removal of heat, facilitated by the material used which is aluminium alloy. Also, the vibrations are dampened by the fact that the component material of the sleeve is different to that of the barrel, which results in opposing and limiting the propagation of vibrations.

The weapon according to the invention has other characteristic arrangement at its locking mechanism.

The barrel release (9) forms a trigger guard in the closed position in order to protect the trigger (17) tang (17.1). The front part (9.1) of the barrel release is profiled to firstly, have a shape (9.2) likely to be inserted into the recess formed in the bottom part of the receiver and therefore be hinged by a pin (18), transversal to the said slideway. The aforementioned shape (9.2) takes a finger (19), vertically projecting externally, likely to cooperate and be inserted into the means (8) making up a slider forming a pedal activated according to the movement of the barrel release in a horizontal path defined by corresponding grooves (4.7) made out on the internal faces, in register with jaws or side plates making up the receiver. Therefore, the slider or pedal, is blocked and positioned with the hook formed on the aforementioned supporting base, blocking and locking the weapon in position.

The front, shouldered part (9.3) of the barrel release also has a blind hole (9.4) taking a finger (21) against elastic means (22) abutting against the bottom face in front of the aforementioned hook. In order to complete the locking which should be without play, without being too tight, an adjusting screw (23) is provided for this purpose at the front of the hinging zone of the base.

Furthermore, the weapon according to the invention comprises a firing block (16) made up of a cube-shaped head, positioned and centered against the top part of the receiver and abutting against a vertical wall (4.8), formed on the receiver.

The firing block is thus fixed by connecting screws (23). There is a possibility of mounting a firing block on the weapon for ring firing (only on the lightweight receiver) or a firing block which provides central firing or ring firing in order to activate either of the firing pins according to the calibers used. The firing pin component itself was referred to as (24) and is likely to be moved in a known manner inside the firing block against elastic return means and therefore project associated finger(s) in order to come into contact with the shell.

Whilst preserving the interchangeability of the parts, this arrangement is provided to separate the materials of the receiver from those of the firing block regardless of the configuration sought after.

The weapon according to the invention is also characteristic by a special arrangement of its firing mechanism.

As previously indicated, the barrel release protects the trigger (17) tang (17.1). In an advantageous manner, the tang (17.1) can be adjusted in position with respect to the trigger, the opposite face of which is provided with, for example, a dovetail groove (17.2) in which a complementary profile slides, made out in the top part of the tang. A connecting screw (25) is provided beforehand to define the position of the trigger tang with respect to its support (17). The trigger itself is profiled and mounted on a hinge pin (26) transversally arranged between the side plates or jaws of the receiver. Pins (28-29) transversally arranged in the side plates limit the angular movement of the trigger, therefore enabling pre-stroke adjustments to be defined before firing the shot or afterwards.

Furthermore, the trigger is profiled at the top part in order to take a finger (30) with a return spring (31) to provide the adjustment of the start of the firing point. The rear part of the trigger has a profiled ramp (17.2) to which an intermediate action lever (32) is applied. The latter is hinged on a pin (33), mounted between the jaws of the receiver. The lever is mounted, capable of pivoting and elastic return, by a hairpin spring (34), one end of which is applied against the pin (29) and the other, is applied against the internal profile of the lever or any other form of it, enabling it to be elastically returned. The action lever is therefore mounted between the trigger and the hammer (35) which is provided to reduce the trigger stroke, undue friction, the firing weight due to the pressure of the hammer which is in the cocked position, giving rise, furthermore to the possibility of using a more powerful hammer spring (36) and which itself, is provided to reduce the hammer stroke time.

The hammer swivels around a pin (37), mounted between the receiver jaws. The hammer has a profiled top part (35.1) to come into contact with the firing pin, a bottom front part (35.2) forming a hook, cooperating with the aforementioned intermediate action lever and a bent bottom rear part (35.3) in the shape of a yoke associated to a control (38) and return (39) means fixed to the rear end of the receiver being inserted into the grip of the weapon.

The weapon according to the invention has another important characteristic relating to a safety mechanism (40). This mechanism comprises an L-shaped obtuse lever (41), the central, bent part (41.1) of which is designed to take a pin (42) likely to be engaged between the jaws or side plates of the receiver, where the hammer is positioned and particularly behind its rotation pin. The bottom end (41.2) of the lever has a notch (41.4) likely to be engaged and hooked onto a finger (43) formed and arranged at the top rear end of the barrel release in order to lock it into position. The other leg of the L-shaped lever has a bent lug (41.3) situated in the top longitudinal plane of the weapon. A return spring (44) mounted on the rotation pin of the L-shaped lever is provided to return it elastically, whereas the rotation pin of the said lever has a flat (42.4).

In the "firing" position, the safety lever (41) is swivelled and maintained in this position only by the finger or lug situated at the end of the barrel release which can only retain it if the barrel release is fully closed. It is to be noted that when in the "firing" position, the lever (41) does not conceal the sighting components and enables the hammer to be cocked.

If, for any reason, the triggering lever is ajar, the safety lever is no longer retained in its position, and, under the effect of the return spring, pivots and puts the pistol into the safety position. In fact, the flat (42.4) made out on the pin (42) is machined so that when in the "firing" position, it does not interfere with the hammer in order for it to go to the end of the stroke and hit the firing pin. Alternatively, in the "safety" position, the pin (42) is positioned so that the rear part of the hammer abuts against the pin before hitting the firing pin. If the hammer is cocked and released accidentally, this has the advantage of preventing the hammer from coming into contact with the firing pin, thereby preventing the shot from being fired. If the hammer is swivelled against the firing block, when the pistol is put into the safety position, it automatically separates the hammer which prevents the firing block from staying out. This special feature is particularly interesting when considered that by simply opening the weapon, it is automatically put into the safety position. Consequently, the weapon is prevented from being reclosed with a cartridge loaded on the firing pin which is projected. Furthermore, it is to be noted that when the weapon is in the "safety"

position, the safety lever conceals the sighting components which has the advantage of preventing the distracted shooter from firing the shot with a weapon which is in the "safety" position after sighting. Besides, the safety lever is big and visible enough so that the people around the shooter can check whether or not it is in the "safety" position at any moment.

The advantages are made well apparent from the invention. The modular feature of the weapon and special features of the different mechanisms which give rise to a particularly efficient, reliable and highly safe weapon, are to be highlighted.

I claim:

1. A one-shot weapon, comprising:

an external grip;

a profiled receiver attached to the grip, the receiver having two spaced apart and parallel jaws defining a space wherein operating mechanisms can pass and be positioned;

a supporting base mounted to a front part of the receiver;

a sleeve connected to the supporting base;

a barrel disposed in the sleeve;

a firing block mounted on the receiver, the firing block having a cube-shaped head mounted on a top part of the receiver and abutting against a vertical wall of the receiver, the firing block being interchangeable on the receiver and allowing for annular or central firing;

a trigger connected to the receiver and operable by a trigger tang;

a barrel release connected to the receiver, the barrel release defining a trigger guard for protecting the trigger tang, the receiver having an adjusting mechanism for enabling adjustment of a trigger stroke; and, a safety mechanism pivotably attached to the receiver.

2. A one-shot weapon according to claim 1, wherein a front part of the receiver defines a yoke, the supporting base being hingedly mounted on a hinge pin secured to the yoke, a rear part of the supporting beam being hooked so as to cooperate with a sliding mechanism, a top part of the supporting base defining a longitudinal recess for receiving an extractor, a middle part of the supporting base defining openings for receiving means for connecting the supporting base to the sleeve.

3. A one-shot weapon according to claim 2, wherein the means for connecting comprises pins, one of the pins enabling rotation of the base with respect to the sleeve.

4. A one-shot weapon according to claim 2, wherein one end of the extractor is T-shaped, the T-shaped end cooperating with notches on the supporting base to provide controlled and limited sliding with respect to the supporting base, a front part of the extractor defines a hook which registers with an outlet of the barrel, and wherein rim recess adjusting washers are disposed between the barrel and the hook of the extractor.

5. A one-shot weapon according to claim 2, wherein the sliding mechanism is connected to the barrel release, the barrel release being hingedly attached to the receiver, a front part of the barrel release being engaged in the receiver, the front part having a finger engaged with the sliding mechanism such that the sliding mechanism is activated by movement of the barrel release, the sliding mechanism being movable in grooves defined in the jaws of the receiver, the sliding mechanism being engageable with the hooked part of the supporting base such that the weapon is locked.

6. A one-shot weapon according to claim 5, wherein the front part of the barrel release has a blind hole for receiving a finger which is biased by elastic means against a bottom face of the supporting base.

7. A one-shot weapon according to claim 1, wherein the trigger tang is adjustable in position with respect to the trigger, the trigger being mounted on a hinge pin disposed between the jaws of the receiver, angular movement of the trigger being limited by transversely disposed pins connected to the receiver which are adjustable in position to enable adjustment of the trigger stroke.

8. A one-shot weapon according to claim 1, wherein a rear part of the trigger defines a ramp, and an intermediate action lever is biased against the ramp by an elastic means, the intermediate action lever being mounted between the trigger and a hammer of the weapon.

9. A one-shot weapon according to claim 8, wherein the hammer is hingedly mounted on a rotation pin, the hammer having a top profiled part which contacts a firing pin of the weapon, a bottom front part defining a hook which cooperates with the intermediate action lever, and a bent rear internal part defining a yoke which cooperates with a control and return means fixed to a rear end of the receiver.

10. A one-shot weapon according to claim 9, wherein the safety mechanism comprises an L-shaped obtuse angle lever, a central part of which is designed to take a pin having a flat surface, the pin being engaged between the jaws of the receiver in a vicinity of the hammer and behind the rotation pin of the hammer, a bottom end of the lever having a slot which engages and hooks onto a finger disposed at a top rear end of the barrel release, an opposite end of the lever having a bent lug disposed in a top longitudinal plane of the weapon, and wherein a return spring positions the lever.

11. A one-shot weapon according to claim 7, wherein the rear part of the trigger defines a ramp, and an intermediate action lever is biased against the ramp by an elastic means, the intermediate action lever being mounted between the trigger and a hammer of the weapon.

12. A one-shot weapon according to claim 11, wherein the hammer is hingedly mounted on a rotation pin, the hammer having a top profiled part which contacts a firing pin of the weapon, a bottom front part defining a hook which cooperates with the intermediate action lever, and a bent rear internal part defining a yoke which cooperates with a control and return means fixed to a rear end of the receiver.

13. A one-shot weapon according to claim 12, wherein the safety mechanism comprises an L-shaped obtuse angle lever, a central part of which is designed to take a pin having a flat surface, the pin being engaged between the jaws of the receiver in a vicinity of the hammer and behind the rotation pin of the hammer, a bottom end of the lever having a slot which engages and hooks onto a finger disposed at a top rear end of the barrel release, an opposite end of the lever having a bent lug disposed in a top longitudinal plane of the weapon, and wherein a return spring positions the lever.

* * * * *